United States Patent [19]

Glassford, Jr.

[11] 4,377,964

[45] Mar. 29, 1983

[54] BASS DRUM MODULATOR

[76] Inventor: William E. Glassford, Jr., 56 Jefferson St., P.O. Box 312, Westville, Ind. 46391

[21] Appl. No.: 289,313

[22] Filed: Aug. 3, 1981

[51] Int. Cl.[3] ..... G10D 13/02

[52] U.S. Cl. ..... 84/411 R; 84/413

[58] Field of Search ..... 84/411–420

[56] References Cited

U.S. PATENT DOCUMENTS

| | | | |
|---|---|---|---|
| 1,233,881 | 7/1917 | Iucci . | |
| 1,579,893 | 4/1926 | Simpson . | |
| 1,892,223 | 12/1932 | Sansone et al. . | |
| 2,205,593 | 6/1940 | Jeffries | 84/419 |
| 2,572,504 | 10/1951 | Meriwether | 84/411 |
| 3,215,021 | 11/1965 | Kester, Jr. | 84/411 |
| 3,685,389 | 8/1972 | Bemben | 84/411 |
| 3,861,265 | 1/1975 | Van der Wyk | 84/411 R |
| 3,951,032 | 4/1976 | LaPorta et al. | 84/419 |
| 4,228,721 | 10/1980 | Hancox | 84/411 |

FOREIGN PATENT DOCUMENTS

| | | | |
|---|---|---|---|
| 463824 | 4/1937 | United Kingdom | 84/411 R |

*Primary Examiner*—Lawrence R. Franklin

*Attorney, Agent, or Firm*—McDougall, Hersh & Scott

[57] ABSTRACT

A device for controlling the tension of a batter head on a bass drum includes a crossbar that is clamped to an annular ring which secures the drum head to the periphery of a drum shell, an operating arm pivotally mounted on the cross-bar, and tensioning means forming a biased roller assembly having a fulcrum member rotatably secured to the crossbar, a first end of the fulcrum member being adjustably connected to the operating arm by a turnbuckle or the like, a second end of the fulcrum member having rollers and being connected to the crossbar by a bias element so that lateral movement of the operating arm causes the fulcrum member to move the rollers across the drum head and change the tension of the head whereby the frequency of vibration or pitch at the drum head and, therefore, the sound of the drum can be modulated while the drum is being played.

8 Claims, 4 Drawing Figures

BASS DRUM MODULATOR

BACKGROUND OF THE INVENTION

The present invention relates to a device for controlling the pitch or tone of a bass drum. Specifically, the device can be operated to change the tension of a batter head on a bass drum to modulate the frequency of vibration at the drum and, therefore, the sound produced by the drum.

A bass drum is a double-headed drum having a hollow cylindrical shell closed at each end by skins or heads that are stretched around the peripheries of the shell and tightened about the shell by means of keys and adjustable bolts or the like. It should be noted that with all bass drums the frequency of vibration of the batter head is controlled by both by the tension of the batter head and by the tension of the outer vibrating head. However, since the tension of a drum head cannot be adjusted while the drum is being played, a conventional bass drum produces a single tone or pitch.

The strength of the blows to the batter head can also influence the tone or pitch produced. But this technique of varying the drum tone by increasing or decreasing the force of the blow to the batter head requires a considerable degree of skill on the part of the drummer. For reference purposes, the term "pitch" as used herein describes the results obtained by changing the tension of the batter head, rather than the sound produced by changes in the loudness of the note.

Over the years, tensioning devices have been developed which can control the tension of the batter head and, therefore, the tone produced by the batter head so that the pitch of the drum can be modulated. But only a limited number of tones can be produced by the majority of these arrangements. In addition, as previously indicated for conventional head tightening means, these assemblies usually require the drummer to stop playing to tune the drum to the desired tone or pitch. Such devices are described below.

DESCRIPTION OF THE PRIOR ART

The following references constitute the closest prior art of which applicant is aware.

U.S. Pat. No. 1,233,881 to Iucci relates to a drum including a resonant non-metallic diaphragm having a ring positioned against the underside thereof which can be adjusted by screw means to relax or tighten the diaphragm. U.S. Pat. No. 1,579,893 to Simpson describes a tone modifier for drums having a construction very similar to that of Iucci.

U.S. Pat. No. 1,892,223 to Sansone et al. discloses a device for converting a conventional kettledrum into a snare drum by the operation of a foot pedal which can selectively bring a set of snares positioned within the drum shell into contact with the lower side of a drum head.

U.S. Pat. No. 2,205,593 to Jeffries shows a foot-operated device for tuning a tympano, or what is commonly referred to as a kettledrum. The device can be adjusted to an infinite number of positions but unlike the present invention cannot be attached and removed easily from the drum.

U.S. Pat. No. 2,572,504 to Meriwether relates to a drum tone modulator having a tone softening pad mounted within a drum adjacent a drum head for contacting and disengaging the drum head upon movement of a hand lever.

U.S. Pat. No. 3,215,021 to Kester discloses a drum sound-varying device that does not act directly on the head of the drum. The drum comprises upper and lower sections connected by a pivot member so that the sections can move towards and away from one another to decrease or increase, respectively, the distance between the drum heads of the sections.

U.S. Pat. No. 3,685,389 to Bemben describes an adjustable pitch drum having a tensioning mechanism that connects a foot pedal to a drum head so that a relatively large movement of the pedal produces a small tensioning movement at the drum head to vary the pitch of the drum.

U.S. Pat. No. 3,951,032 to LaPorta et al. shows a padded dampening plate for contacting the underside of a drum head to muffle or silence the drum. A foot lever permits hands-free operation.

U.S. Pat. No. 4,228,721 to Hancox refers to a drum turning mechanism having one or more deadening elements mounted within a drum shell and in contact with the underside of a drum head to vary the tension of the head. This device is also operated by a foot pedal.

Accordingly, it will be noted that the prior art includes several devices which can be used to produce different drum tones or resonant effects; but most of the referenced devices can produce only two drum tones and no device can be mounted to the exterior surface of a drum shell as easily as the present device which can be fastened to the exterior of any conventional bass drum to produce an infinite variety of tones.

SUMMARY OF THE INVENTION

The present invention overcomes the disadvantages of previously designed control devices for bass drums by permitting a drummer to change the pitch of the drum as the drum is being played. In current practice, a drummer often uses several differently tuned bass drums to obtain a range of effects and tones. The present device is attached to the exterior of a bass drum shell and communicates with the batter head to increase the range of tones produced by a single bass drum, thereby eliminating the need for several differently tuned drums to obtain the desired range of tones. Indeed, an infinite range of tones can be continuously produced from a single drum by use of this invention.

The device includes a crossbar which is clamped to an annular ring that secures the drum head to the periphery of the drum shell, an operating arm pivotally mounted on the crossbar and tensioning means forming a biased roller assembly having a fulcrum member rotatably secured to the crossbar, a first end of the fulcrum member being adjustably connected to the operating arm by a turnbuckle or the like, a second end of the fulcrum member having rollers and being connected to the crossbar by a bias element so that lateral movement of the operating arm causes the fulcrum to move the rollers across the drum head and change the tension of the head whereby the frequency of vibration or pitch at the drum head and, therefore, the sound of the drum can be modulated while the drum is being played.

DETAILED DESCRIPTION OF THE INVENTION

A bass drum includes a batter head 12 and an outer vibrating head (not shown) which are stretched across a hollow cylindrical drum shell 14 and held thereon by means of an annular ring 16 positioned about each end of the drum shell. The tension of the heads is adjusted by a plurality of axial bolt assemblies 18 which cooperate between the annular ring 16 to secure the batter and outer vibrating heads.

Figure 1:
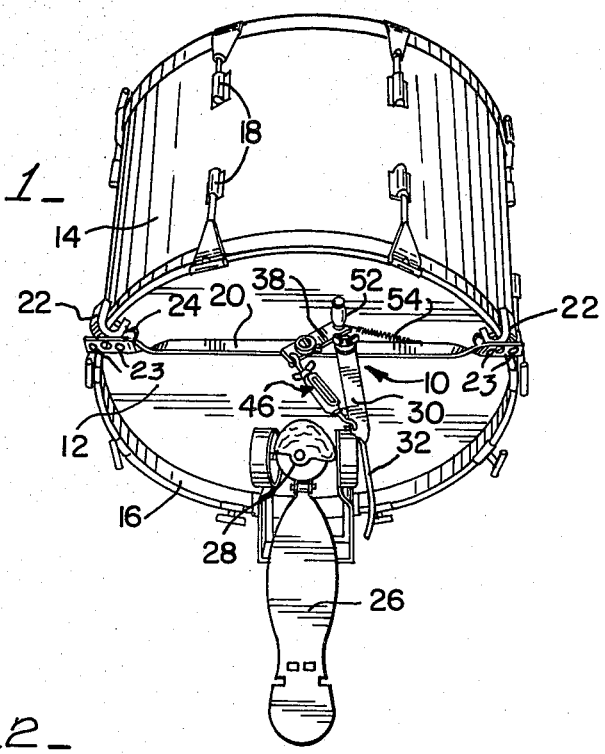
FIGS. 1 and 2 are perspective views of the device of the present invention.

Referring to FIG. 1, the device of the present invention which is indicated generally by reference numeral 10 comprises a crossbar 20 having a clamp 22 at each end thereof for securing the device to the annular ring 16 positioned about the periphery of the drum shell 14. The clamp 22 can be secured to the crossbar 20 through one of several holes 23 at each end of the crossbar. The holes 23 are provided to permit adjustment of the vertical position of the crossbar relative to the annular ring. The clamp 22 can be C-shaped or the like and includes screw means 24, such as a thumbscrew, for tightening the clamp 22 to the annular ring 16. In this manner, the device can be mounted across the outer surface of the batter head 12 and can be operated (as will be described with reference to FIGS. 3 and 4) to change the tone or pitch of the drum. As illustrated in FIG. 1, the drum is played by depressing a foot pedal 26 and forcing a percussion member 28 against the head 12.

Figure 2:
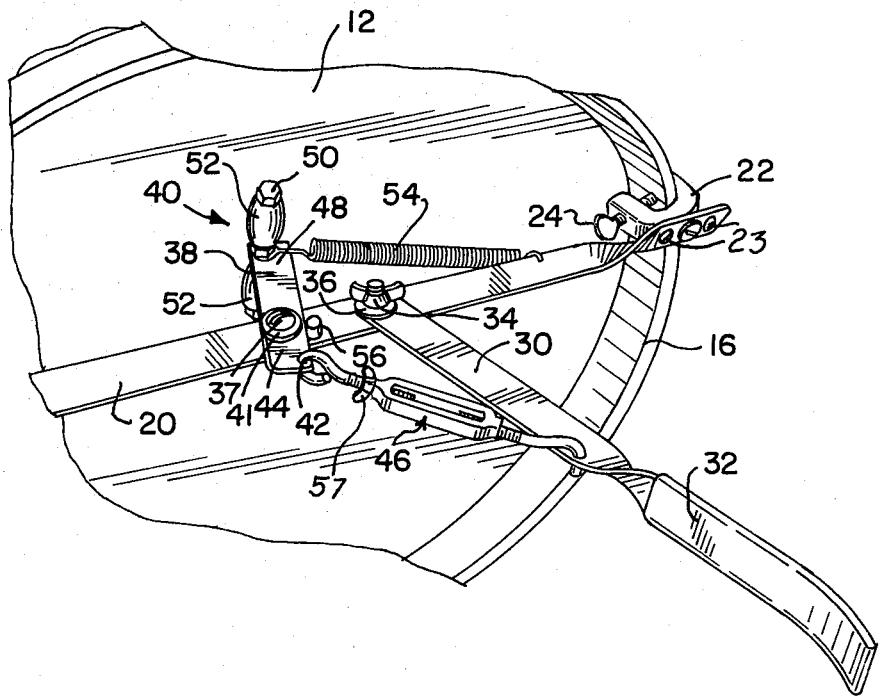

Referring now to FIG. 2, an operating arm 30 having a removable handle section 32 which slides onto the operating arm at one end thereof is pivotally mounted on the crossbar 20. The handle section 32 is contoured to accommodate the leg or knee of the drummer, and, according to the preference of the drummer, the handle section can be removed and replaced by a handle section having a different length. The operating arm 30 further includes a hole (not shown) in the end opposite the handle section 32. A bolt and wing nut assembly 34 can be passed through that hole in the operating arm 30 and a similar hole (also not shown) in the crossbar 20 to pivotally mount the operating arm to the crossbar. A washer 36 is provided to enable tightening of the bolt and wing nut assembly 34, but to permit the operating arm to pivot relative to the crossbar.

Also connected to the crossbar 20 by a bolt and nut assembly 37 for rotational movement is a fulcrum member 38 which is a component of a biased roller or tensioning means 40. A washer 41 can be provided for easy rotation of the fulcrum member 38. An opening 42 in a first end 44 of the fulcrum member 38 is adjustably connected to the operating arm 30 by a turnbuckle 46 or the like. Another opening in a second end 48 of the fulcrum member receives a shaft assembly 50 comprising an elongated threaded shaft and a nut for supporting rollers 52. One end of a spring or bias element 54 is attached to the shaft assembly 50, while the other end of the bias element is attached to the crossbar 20. The rollers 52 are rotatably mounted to the shaft to engage the drum head 12 and move thereon in response to movement of the operating arm 30. In particular, lateral movement of the operating arm 30 causes the fulcrum member 38 to move the rollers 52 across the drum head 12 and change the tension of the head whereby the frequency of vibration or the pitch of the drum head can be controlled.

Stop means 56 comprising an upright post member is mounted on the crossbar 20 between the points where the operating arm 30 and the fulcrum member 38 are mounted on the crossbar. As will be described, stop means 56 defines the extent to which the fulcrum member 38 can swing towards the operating arm 30.

The turnbuckle 46 should be positioned by adjusting its locking wing nut 57 to extend the spring or bias element 54 when the device is in the open position. In this manner, tension is maintained and pressure against the operating arm 30 is required to move the arm in a lateral direction. As used herein, the term "open position" indicates the resting configuration of the device 10 as secured to the drum. Once the operating arm is moved laterally relative to the drum head 12, the fulcrum member 38 is pivoted on the cross member 20 to move the rollers 52 across the drum head, and the bias element 54 is further extended. The angle of rotation of the fulcrum member 38 is defined by the position of the stop means 56. When the fulcrum member 38 contacts the stop means 56, the device is in what is referred to herein as the "closed position". It will be appreciated that the rollers 52 can also be positioned along the drum head 12 at any location between the open and closed positions. In this manner, the pitch of the drum can be modulated.

Figure 3:
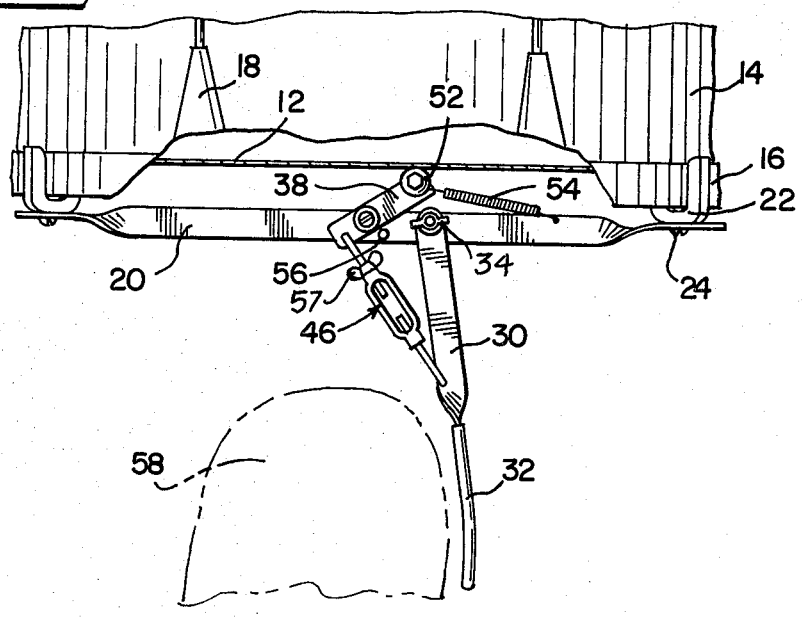
FIG. 3 is a partial sectional top view of the device in the open or relaxed position.

FIG. 3 shows the device with the operating arm 30 in the open position so that the rollers 52 do not contact, or at most only barely contact, the drum head 12. The knee 58 (shown in phantom) of the drummer does not touch the handle section 32.

Figure 4:
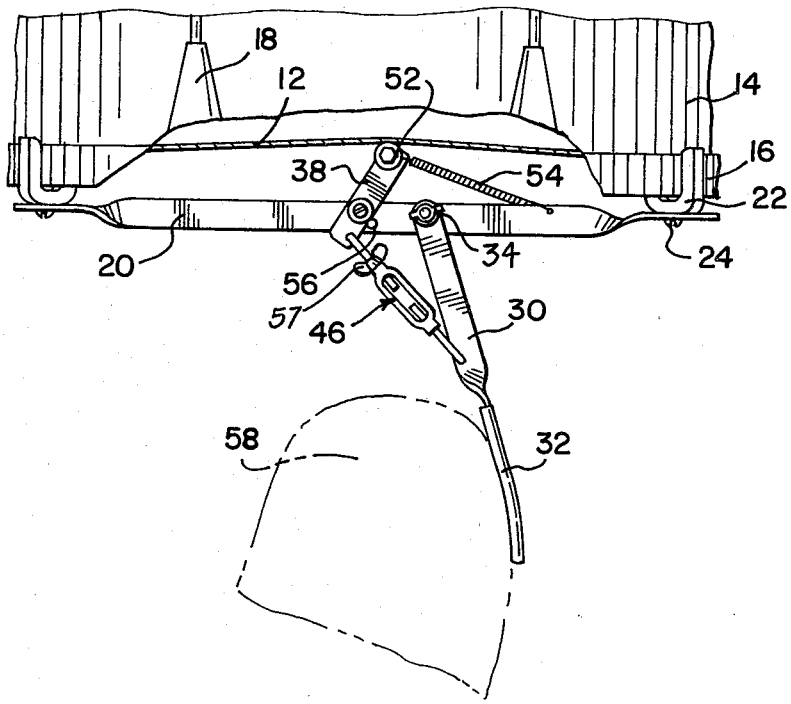
FIG. 4 is a partial sectional top view of the device in the closed or contracted position.

FIG. 4, on the other hand, illustrates the device with the operating arm 30 contracted or moved laterally relative to the drum head 12 into the closed position so that the rollers 52 move along the drum head thereby stretching the head. In this manner, upon depressing the foot pedal 26 and striking the drum head with the percussion member 28, the frequency of vibration or the pitch of the drum is changed. There are, of course, an infinite number of positions between these two extremes; and depending on the tension of the bias element 54, the setting of the turnbuckle 46 and the position of stop means 56, the range of tones can be broadly or narrowly defined. Each position of the rollers 52 places a slightly different strain on the drum head so that the number of drum tones which can be achieved upon moving the operating arm is unlimited.

It should be noted that a drummer can use the present device from the standing or sitting position. In either case, the leg or knee of the drummer applies the force necessary to move the operating arm laterally relative to the drum head 12. Alternatively, a hand-operated operating arm can be used. Because the pressure on the operating arm may cause the drum to tip, additional bracing means may be necessary to support the drum. This can be accomplished in conventional fashion by placing the bass drum between several other drums when playing or by providing a more sturdy stand for the drum.

In addition, the wingnut of the bolt assembly 34 can be loosened and the turnbuckle 46 can be detached from the fulcrum member 38 to remove the operating arm 30 from the crossbar 20 for packing and transporting the drum. Therefore, the device 10 need not be completely dismantled for convenient transportation of the drum.

It will be understood that various changes and modifications can be made in the construction described without departing from the spirit of the invention, particularly as defined in the following claims.

That which is claimed is:

1. A device for adjusting the tension of a membrane stretched diametrically across the periphery of a drum shell to form a head of a bass drum comprising:

(a) an elongated cross member including means for mounting the cross member across the periphery of the drum shell in spaced relation relative to the head;

(b) an operating arm pivotally connected to said elongated cross member for lateral movement relative to the drum head; and (c) tensioning means operatively connecting said operating arm to the center portion of the drum head, said tensioning means comprising (i) a fulcrum member with a first end pivotally connected to said elongated cross member and a second end of the fulcrum member including a roller assembly which contacts the center portion of the drum head, (ii) bias means joining the second end of the fulcrum member to the elongated cross member to maintain tension between the operating arm and the drum shell as the operating arm is moved, (iii) tightening means to adjustably connect the first end of the fulcrum to the operating arm, and (iv) stop means to restrict movement of the fulcrum member towards said operating arm whereby lateral movement of the operating arm relative to the drum head moves the roller assembly across the center portion of the drum head to change the tension of the drum head and modulate the pitch of the drum as the drum is being played.

2. A device in accordance with claim 1 wherein the elongated cross member can be mounted across the periphery of the drum shell whereby the device can be fastened to the exterior of the drum shell without the removal of the drum head.

3. A device in accordance with claim 1 wherein the pitch of the drum can be modulated within an infinite range upon movement of said operating arm relative to the drum head.

4. A device in accordance with claim 1 wherein said tightening means comprises a turnbuckle which can be adjusted to vary the tension of said tensioning means and the position of the operating arm relative to the drum head.

5. A device in accordance with claim 1 wherein said bias means comprises a spring which connects the second end of the fulcrum member to the elongated cross member to maintain tension between the operating arm and the drum shell as the operating arm is moved.

6. A device in accordance with claim 1 wherein said operating arm is pivotally connected to said elongated cross member by removable screw means whereby the operating arm can be removed for packing and transporting the drum.

7. A device in accordance with claim 1 wherein said means for mounting the elongated cross member across the periphery of the drum shell comprises a C-shaped clamp.

8. A device in accordance with claim 1 wherein said operating arm includes a removable handle section against which pressure can be applied to move the operating arm.

* * * * *